US008123585B1

(12) United States Patent
Strong

(10) Patent No.: US 8,123,585 B1
(45) Date of Patent: Feb. 28, 2012

(54) GYROSCOPIC TOY

(76) Inventor: Finn A. Strong, San Rafael, CA (US)

( * ) Notice: Subject to any disclaimer, the term of this patent is extended or adjusted under 35 U.S.C. 154(b) by 224 days.

(21) Appl. No.: 12/705,977

(22) Filed: Feb. 15, 2010

Related U.S. Application Data

(60) Provisional application No. 61/207,526, filed on Feb. 14, 2009.

(51) Int. Cl.
*A63H 1/00* (2006.01)
*A63H 33/18* (2006.01)

(52) U.S. Cl. ..... 446/233; 446/259; 473/588

(58) Field of Classification Search ..... 446/46, 446/47, 233, 234, 235, 236, 246, 255, 259, 446/262, 264, 266; 482/110, 138; 473/569, 473/588, 594, 595
See application file for complete search history.

(56) References Cited

U.S. PATENT DOCUMENTS 4,153,252 A * 5/1979 Sullivan ..... 473/588
4,253,269 A * 3/1981 Sullivan ..... 446/46
4,337,593 A * 7/1982 McAllister ..... 446/236
D453,359 S * 2/2002 Naslund ..... D21/301
2005/0101454 A1 * 5/2005 Dworzan ..... 482/110

* cited by examiner

*Primary Examiner* — Nini Legesse
(74) *Attorney, Agent, or Firm* — Patent Law Offices of Michael E. Woods; Michael E. Woods

(57) ABSTRACT

A method, system and apparatus for a solution that safely enables a person to safely operate a body-engaging gyroscopic toy. A gyroscopic toy includes a gyroscopic disk body; an elongated central axle rod extending from both sides of the disk body, the axle rod defining a pair of body-engagement handles; and a safety, selectably releasably engaging the axle rod to a rotational axis of the disk body, inducing a rotation of the axle rod about a lateral axis of the axle rod in response to a rotation of the disk body wherein the safety disengages the induced rotation of the axle body upon an application of an anti-rotation force to the axle whenever the anti-rotation force exceeds a predetermined threshold wherein the disk body continues to rotate freely and the axle rod rotates slower than the disk body while the anti-rotation force is applied.

4 Claims, 5 Drawing Sheets

GYROSCOPIC TOY

CROSS REFERENCE TO RELATED APPLICATIONS

This Application claims the benefit of U.S. Provisional Application 61/207,526 filed on Feb. 14, 2009.

BACKGROUND OF THE INVENTION

This invention relates to gyroscopic toys or educational gyroscopic devices, specifically to a gyroscopic device that is manipulated by the user's hands and body, utilizing gyroscopic principles, to keep it in play.

Gyroscopic toys or devices primary purposes include: demonstration of the gyroscopic principle for education or entertainment, as in toy tops; stabilization, as in a steady-cam device; or orientation, as in navigation systems. The problem with these applications is they are mostly a hands-off experience or hidden altogether. Besides the initial spin of a top, there is no direct physical interaction, the user just watches passively. The user does not feel the forces that are present with the gyroscopic effect. Nor does the user learn how to negotiate the seemingly magical forces at play.

A greater that a rotational inertia of a gyroscope has, the more pronounced the gyroscopic force is and it is easier to implement and enjoy the effects. For young adults, there is a concern for safety when manipulating a gyroscopic toy, particularly as the rotational inertia becomes larger and the toy is more adapted to roll and interact with the user's body.

It would be desirable to provide a gyroscopic toy that safely involves the user and requires the use of his/her hands and or body to directly manipulate, negotiate, follow and feel the gyroscopic effect

BRIEF SUMMARY OF THE INVENTION

Disclosed is a method, system and apparatus for a solution that enables a person to safely operate a body-engaging gyroscopic toy. A gyroscopic toy includes a gyroscopic disk body; an elongated central axle rod extending from both sides of the disk body, the axle rod defining a pair of body-engagement handles; and a safety, selectably releasably engaging the axle rod to a rotational axis of the disk body, inducing a rotation of the axle rod about a lateral axis of the axle rod in response to a rotation of the disk body wherein the safety disengages the induced rotation of the axle body upon an application of an anti-rotation force to the axle whenever the anti-rotation force exceeds a predetermined threshold wherein the disk body continues to rotate freely and the axle rod rotates slower than the disk body while the anti-rotation force is applied.

A method of operating a toy gyroscope includes the steps of: (a) rotating gyroscopically a disk body; (b) inducing a rotating of an elongated central axle rod extending from both sides of the disk body in response to the rotating of the disk body; (c) reducing the inducing of the rotating of the elongated central axle rod upon application of an anti-rotation force to the axle rod that exceeds a pre-determined threshold wherein the disk body continues to rotate freely and the axle rod rotates slower than the disk body while the anti-rotation force is applied Preferred embodiments of the present invention include a hand and body manipulated gyroscopic toy or device having a central disk with a weighted outer edge and an elongated center axle rod placed in perpendicular relationship to the disk. The center axle rod has a one-way ratchet interface with the disk that provides a slight resistance in the free wheel direction so that the gyroscopic toy can climb body surfaces and perform tricks properly. To initiate play the user rolls the center axle rod between their hands or fingers until the disk is spinning fast enough to create the gyroscopic effect. Once the gyroscopic principle is in effect, the user can utilize the gyroscopic toy to perform tricks with his/her hands and body that seem to defy gravity.

Accordingly, several objects and advantage of the present invention are: (a) to provide a gyroscopic toy or device that allows the user to experience the forces of the gyroscopic effect physically; (b) to provide a gyroscopic toy or device that teaches and inspires interest in the physics of the gyroscopic effect; (c) to provide a gyroscopic toy or device that displays the gravity-defying effects of the gyroscopic effect; (d) to provide a gyroscopic toy or device that forces the user to fully interact with his/her hands and body by following, negotiating and manipulating the gyroscopic effect in order to keep it in play; (e) to provide a gyroscopic toy or device that is challenging and continually provides new levels of play and magic; (f) to provide a gyroscopic toy or device that is safe and will release when tangled, such as in clothing or hair; (g) to provide a gyroscopic toy or device that can be thrown or caught with unexpected magical effect; (h) to provide a gyroscopic toy or device with interchangeable surface colors and patterns so that when spun, the colors visually mix and transform into different colors and patterns; (i) to provide a gyroscopic toy or device that allows whistles to be applied to the surface so when spun at different speeds it makes different sounds; (j) to provide a gyroscopic toy or device that allows small LED lights to be applied so that when spun creates tracer patterns; (k) to provide a gyroscopic toy or device that has a protective soft outer edge so that it safe for the user and can be played indoors; (l) to provide a gyroscopic toy or device that is strong and ridged enough to handle the inherent gyroscopic forces between the axle rod or handle and the spinning disk; (m) to provide a gyroscopic toy or device wherein the relation between the disk and axle rod or handle is strong and ridged enough so as not to impede or suck the momentum or energy from the toy or device allowing longer play between windings; (n) to provide a gyroscopic toy or device that can be disassembled and stored or shipped relatively flat; (o) to provide a gyroscopic toy or device that has a disk with a weighted outer ring so that it provides more stability, momentum and longer play between wind-ups; (p) to provide a gyroscopic toy or device with an elongated center axis or axle so that it is easy to handle and negotiate with ones' hands or body; (q) to provide a gyroscopic toy or device with a one-way ratchet interface between the axle and disk so that it will release if caught or tangled in hair, yet with enough resistance in the free wheel direction so that it can climb body surfaces and perform tricks properly; (r) to provide a gyroscopic toy or device with an elongated axle for easy handling with safety caps placed on the ends; (s) to provide a gyroscopic toy or device with an elongated axle for easy handling with a one-way ratchet interface with a disk so that it can be easily wound-up without having to let go of the axle handles.

An advantage of this invention is to provide a full-immersion and interactive means to experience the physical phenomenon of the gyroscopic principle. These and other advantages of the present invention will be evident upon a review of the application including the specification, drawing, and claims.

DETAILED DESCRIPTION OF THE INVENTION

The present invention relates to a method, system and apparatus for enabling a person, particularly a young adult, to safely operate a body-engaging gyroscopic toy. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Figure 1:
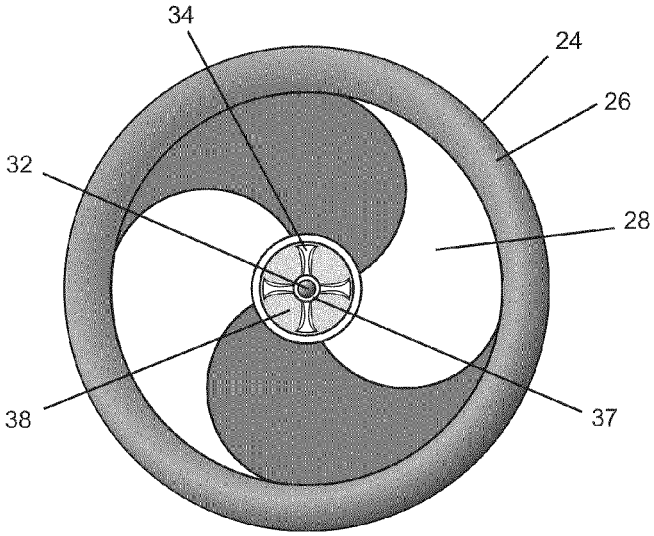
FIG. 1 is a side view of the gyroscopic toy.

FIG. 1 is a side view of the gyroscopic toy 24 constructed in accordance with the invention. The parts consist of a disk body 28 surrounded by a foam or other soft material outer ring 26. In the center of the disk body 28 is the center hub 38 of the disk body that has on its surface a series of raised knobs 34. Rod end cap 32 covers the tip of the center axle rod, shown in FIG. 2.

Figure 2:
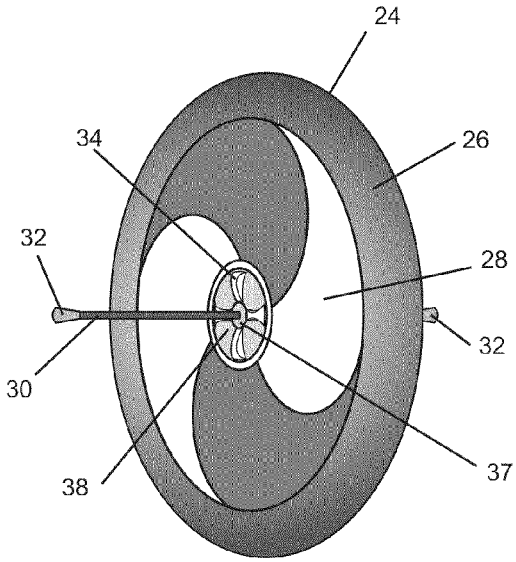
FIG. 2 is a perspective angle view of the gyroscopic toy.

FIG. 2 is a perspective view of the gyroscopic toy 24 with disk body 28 surrounded by the foam outer ring 26 and center hub of disk body 38 with raised knobs 34. At the base of center axle rod 30 is the axle hub body 37. On the ends of the center axle rod 30 are rod end caps 32.

Figure 3:
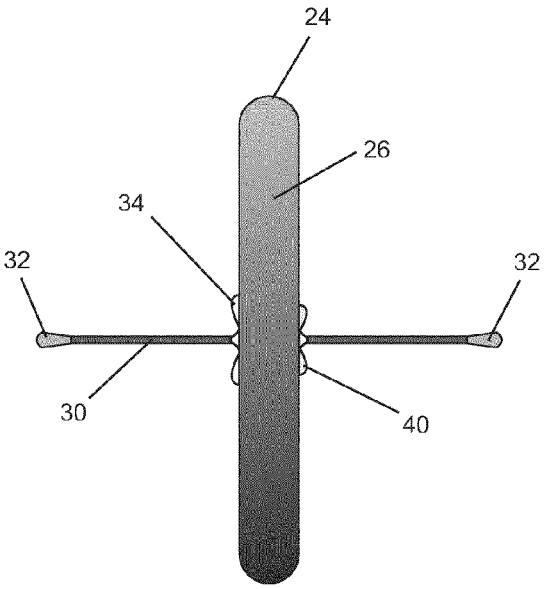
FIG. 3 is a front view of the gyroscopic toy.

FIG. 3 is a front view of the gyroscopic toy 24 with the foam outer ring 26 in the center. Placed on the ends of the center axle rod 30 are the rod end caps 32. On the center hub of disk body 28, as shown in FIG. 1 are raised knobs 34. On the axle hub body 37, shown in FIG. 5 are raised knobs 40.

Figure 4:
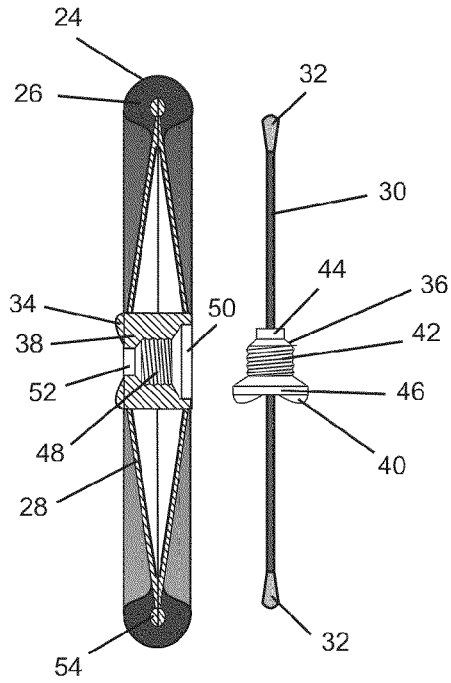
FIG. 4 is a front cross section view of the disk body beside the axle hub assembly.
Figure 5:
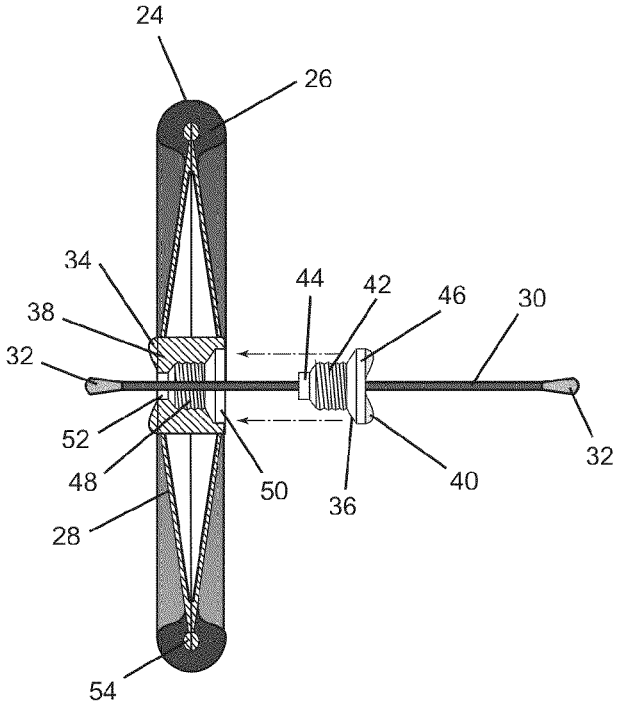
FIG. 5 is a front cross section view of the disk body and the axle hub assembly in the process of being assembled.
Figure 6:
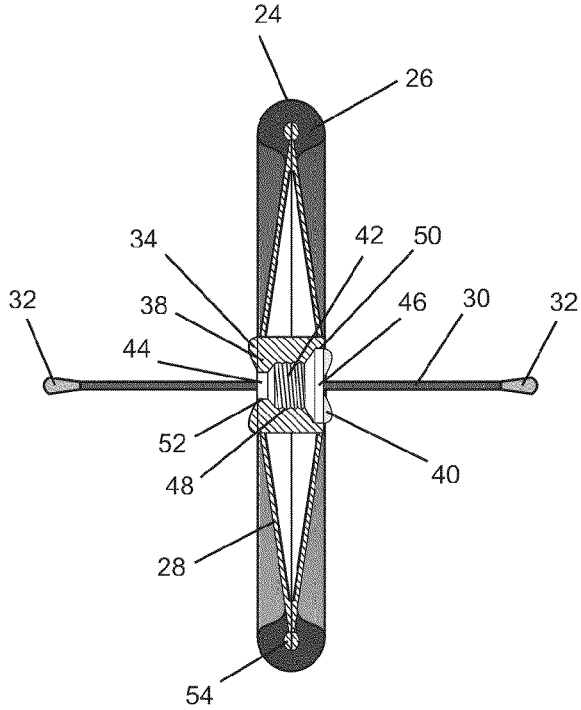
FIG. 6 is a front cross section view of the disk body and the axle hub assembly in the assembled position.

FIGS. 4, 5, and 6 show how the disk body 28 and the axle hub assembly 36 can be disassembled from each other and stored and shipped flat. FIG. 4 is a front cross-section view of the disk body 28 disassembled beside the axle hub assembly 36. FIG. 5 shows how to assemble the disk body 28 and the axle hub assembly 36. The disk body 28 consists of the foam outer ring 26 which is placed around the weighted outer ring 54. In the center of the disk body 28 is the center hub of the disk body 38 with raised knobs 34. Within the center hub of the disk body 28 is reference surface 52 for added strength and stability when the axle hub assembly 36 is inserted to engage reference surface 44 of the axle hub assembly 36. Screw threads of disk body 48 are designed to securely engage the screw thread 44 on the axle hub body 37. Reference surface 50 of the disk body 28 engages with reference surface 46 of axle hub body 37. Raised knobs 40 are on the surface of the axle hub body 37. The axle hub body 37 is placed in the center of the center axle rod 30. The rod end caps 32 cover the ends of the center axle rod 30. FIG. 6 shows all of the previously mentioned elements fully assembled.

Figure 7:
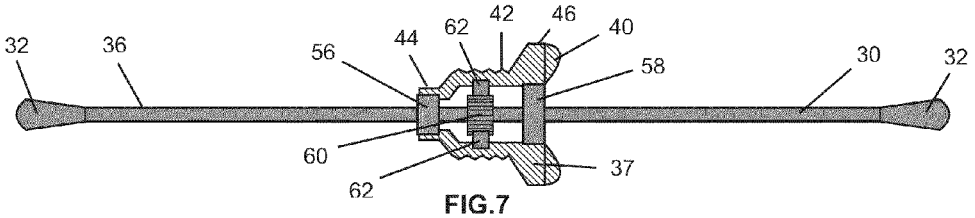
FIG. 7 is a front cross section view of the axle hub assembly with a ratchet and pawl option (A) and bearing assembly.
Figure 8:
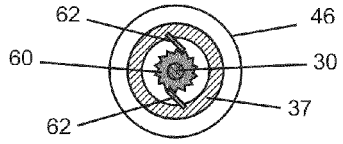
FIG. 8 is a side cross-section view of the axle hub assembly showing ratchet/pawl option (A)

FIGS. 7 and 8 show one potential ratchet system within the axle hub assembly 36. In FIG. 7 the ratchet system consists of a ratchet 60 with teeth placed on the outer circumference that is attached in a fixed position to the center axle rod 30. Pawls 62 are attached to the axle hub body 37 in a fixed position and engage with the teeth of the ratchet 60. On either side of the ratchet system are bearing assemblies 56 and 58. FIG. 8 is a side cross-section view of axle hub body 37 and ratchet assembly as described in FIG. 7.

Figure 9:
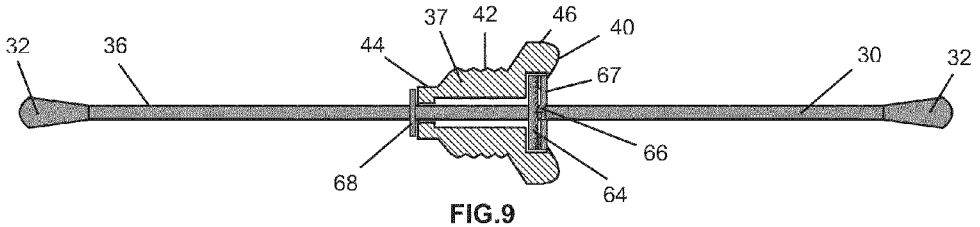
FIG. 9 is a front cross section view of axle hub assembly with ratchet/pawl option (B)
Figure 10:
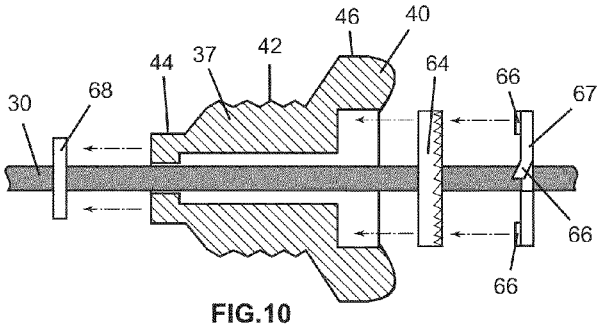
FIG. 10 is a front cross section exploded view of the axle hub assembly showing the parts of ratchet/pawl option (B)
Figure 11:
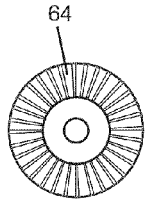
FIG. 11 is a side view of ratchet option (B)
Figure 12:
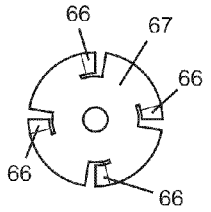
FIG. 12 is a side view of pawl option (B)
Figure 13:
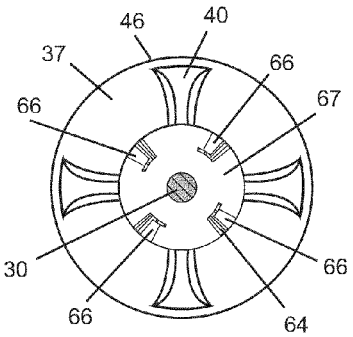
FIG. 13 is a side view of ratchet/pawl option (B) assembled.

FIGS. 9, 10, 11, 12 and 13 show another potential ratchet system within the axle hub assembly 36. In FIG. 9 the ratchet system consists of a ratchet 64 with teeth on the face surface designed to engage with pawls 66 on the pawl disk 67. The ratchet 64 is attached in a fixed position to the hub body assembly 37. The pawl disk 67 is attached in a fixed position to the center axle rod 30. A stop washer is also attached to the center axle rod 30 to keep the axle hub body 37 from sliding. FIG. 10 is a close-up front cross-section exploded view of the axle hub assembly and racket system showing all of the elements from FIG. 9 in more detail. FIG. 11 is a side view of the ratchet 64. FIG. 12 is a side view of the pawl disk 67. FIG. 13 is a side view of ratchet 64 and the pawl disk 67 assembled within the axle hub body 37 with the center axle rod 30 shown in cross-section.

Figure 14:
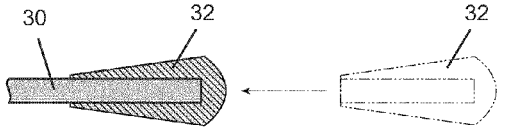
FIG. 14 is a front cross-section view of axle end caps assembled.

FIG. 14 is a front cross-section view showing the center axle rod 30 with assembled end-caps 32 shown in cross-section.

Figure 15:
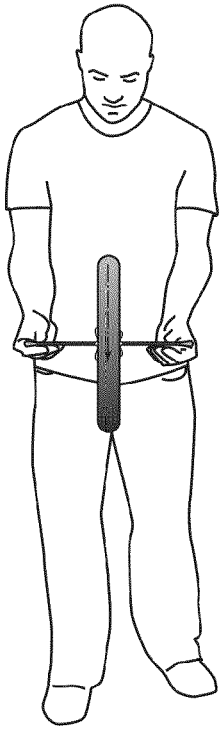
FIG. 15 is a front view of a user starting to spin the gyroscopic toy with hands on either side of disk.
Figure 16:
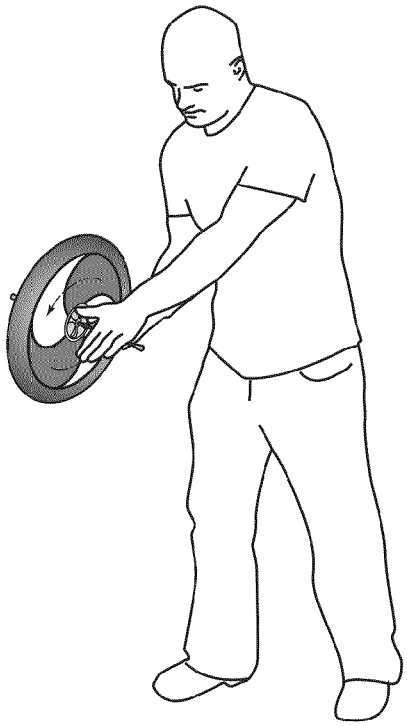
FIG. 16 is an angled view of a user starting to spin the gyroscopic toy with two hands on one side of disk.
Figure 17:
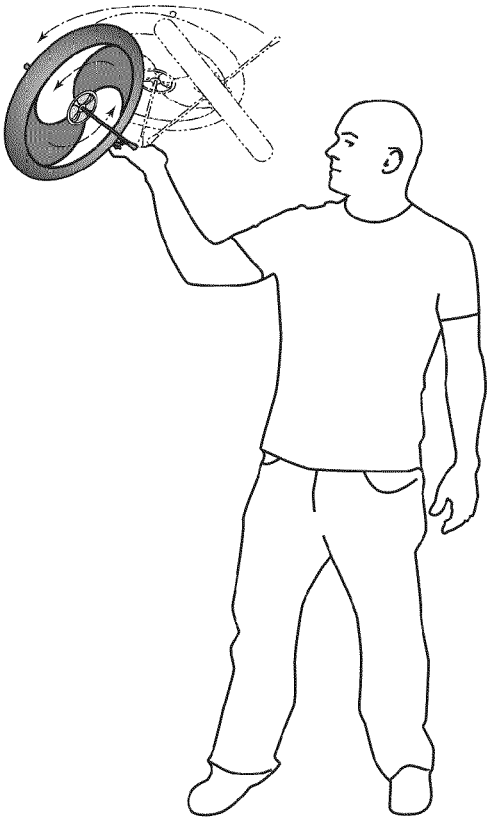
FIG. 17 is an angled view of a user doing an overhead move with the gyroscopic toy with one hand contacting only the very end of the center axle rod with phantom lines showing how the entire assembly rotates around the contact point while not falling down.
Figure 18:
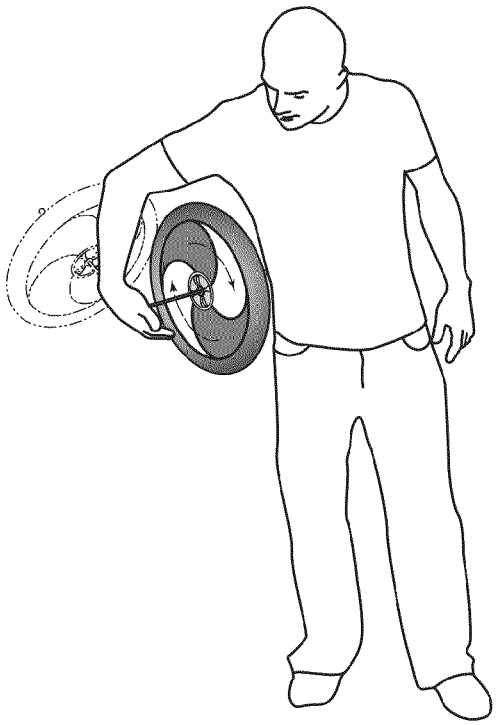
FIG. 18 is an angled view of a user doing an under arm move with the gyroscopic toy with one hand while contacting only the very end of the center axle rod, with phantom lines showing how the entire assembly rotates around the contact point while not falling down.
Figure 19:
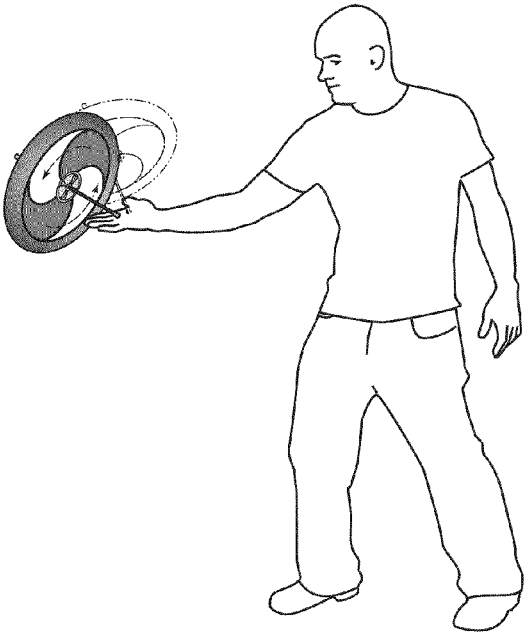
FIG. 19 is an angled view of a user doing a wide circumference side move with the gyroscopic toy with one hand while contacting only the very end of the center axle rod with the phantom lines showing how the entire assembly rotates around the contact point while not falling down.
Figure 20:
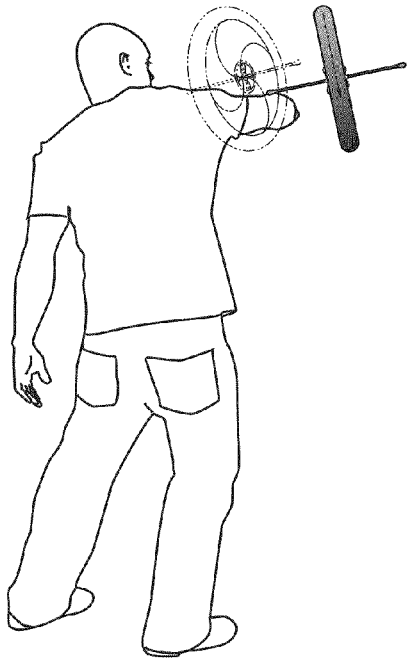
FIG. 20 is a front view of the gyroscopic toy showing it climbing up the user's arm with phantom lines showing its projected path.
Figure 21:
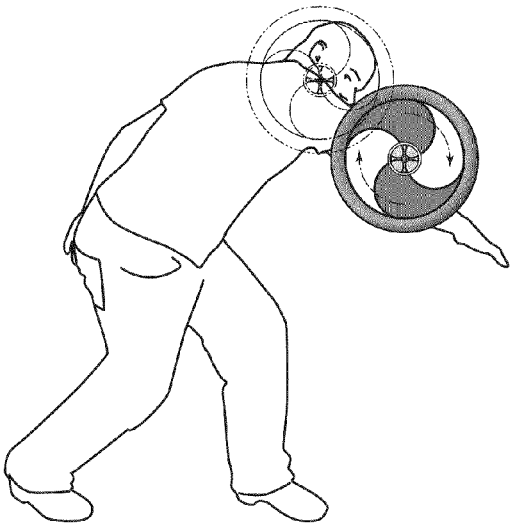
FIG. 21 is a side view of the gyroscopic toy showing it running down the user's arm with phantom lines showing its previous position.
Figure 22:
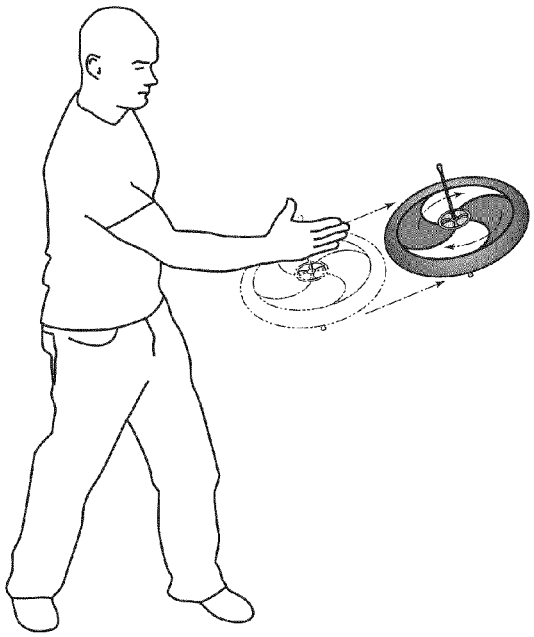
FIG. 22 is an angled view of the gyroscopic toy being thrown.

FIGS. 15-22 show various options for interacting with the gyroscopic toy 24. FIG. 15 shows a front view of a user starting to spin the gyroscopic toy 24 with hands on the central axle rod 30 on either side of disk body 28. FIG. 16 shows an angled view of a user starting to spin the gyroscopic toy 24 with two hands on the central axle rod 30 on one side of disk body 28. FIG. 17 shows an angled view of a user doing an overhead move with the gyroscopic toy 24 with one hand contacting only the vary end of the center axle rod 30. The phantom lines show how the entire assembly rotates around the contact point while not falling down. FIG. 18 shows an angled view of a user doing an under arm move with the gyroscopic toy 24 with one hand while contacting only the very end of the center axle rod 30. The phantom lines show how the entire assembly rotates around the contact point while not falling down. FIG. 19 shows an angled view of a user doing a wide circumference side move with the gyroscopic toy 24 with one hand while contacting only the very end of the center axle rod 30. The phantom lines show how the entire assembly 36, 28 rotates around the contact point while not falling down. FIG. 20 shows a front view of the gyroscopic toy 24 showing it climbing up the user's arm with phantom lines showing its projected path. FIG. 21 shows a side view of the gyroscopic toy 24 showing it running down the user's arm with phantom lines showing its previous position. FIG. 22 shows an angled view of the gyroscopic toy 24 being thrown by the central axle rod 30.

Operation

In operation of the gyroscopic toy 24, the user rolls or spins the center axle rod 30 which is placed perpendicularly to the disk body 28. For ergonomic reasons the center axle rod 30 is elongated to make it easier to hold and manipulate. The disk body 28 has a weighted outer ring 54 covered with a soft foam-like material for safety when playing with others or indoors. In the middle of center axle rod 30 where it joins with the disk body 28 is the axle hub body 37. Inside the axle hub body is a one-way ratchet and pawl system 60, 62, 64, 66, 67 which provides the disk body 28 with slight resistance in the free-wheel direction as it spins so that it can climb body surfaces and perform tricks properly. This resistance is designed to release in case the user's hair or clothing gets tangled. The axle hub assembly 36 can be removed entirely from the disk body 28 so the gyroscopic toy 24 can be stored or shipped relatively flat.

To initiate play one rolls the center axle rod 30 between ones hands or fingers until the gyroscopic toy 24 is spinning fast enough to create the gyroscopic effect. The faster the disk 28 spins the more stable and oriented it becomes. At this point the user can let go of one side of the center axle rod 30 and the gyroscopic toy 24 will seemingly defy gravity and remain in roughly the same orientation even though it is being held considerably off-center. However, the user must follow the gyroscopic toy's 24 lead and negotiate with it in order to control it. Because of the gyroscopic principles, the gyroscopic toy 24 naturally wants to rotate perpendicularly in relation to the spinning disk body 28 if held off-center. By manipulating this rotation the user can prolong the gyroscopic toy 24 from succumbing to gravity and falling. If the user speeds up or pushes the natural perpendicular rotation in relation to the spinning disk body 28, the entire assembly 28, 36 will start to stand-up in a top-like orientation where the disk body 28 goes from a vertical orientation to a horizontal orientation. The speed of perpendicular rotation in relationship to the spinning disk body 28 is also dependant on the point of contact between the user and the center axle rod 30. The closer the user contacts the center axle rod 30 in relationship to the spinning disk body 28 the slower the perpendicular rotation needs to be to keep the gyroscopic toy 24 from falling. The further out the user contacts the center axle rod 30 in relation to the spinning disk body 28 the faster the perpendicular rotation needs to be to keep the gyroscopic toy 24 from falling. This perpendicular rotation in relation to the spinning disk 28 can be done in many ways, by rotating one's hand around the gyroscopic toy 24, by letting the gyroscopic toy 24 rotate around one's hand or by rotating one's entire body. Changing direction of this rotation is as easy as contacting the opposite side of the center axle rod 30.

Part of the magic is due to the difference in diameters between the spinning disk body 28 and the center axle rod 30. The smaller the diameter of the center axle rod 30 in relation to the larger diameter of the spinning disk body 28, the slower the user's response has to be. Because of this difference in diameter, the spinning disk body's 28 outer edge is moving at a higher rate of speed while the center axle rod 30 is slowly rolling along ones hands and body thus seemingly warping reaction time. The leverage is also so great that it allows the center axle rod 30 to climb up body surfaces seemingly defying gravity in yet another way.

The advantage of this invention is to provide a safe, full-immersion and interactive means to experience the physical phenomenon of the gyroscopic principle.

In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application. It is also within the spirit and scope of the present invention to implement a program or code that can be stored in a machine-readable medium to permit a computer to perform any of the methods described above.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. A gyroscopic toy comprising:

a gyroscopic disk body;

an elongated central axle rod extending from both sides of said disk body, said axle rod defining a pair of body-engagement handles; and a safety, selectably releasably engaging said axle rod to a rotational axis of said disk body, inducing a rotation of said axle rod about a lateral axis of said axle rod in response to a rotation of said disk body wherein said safety disengages said induced rotation of said axle body upon an application of an anti-rotation force to said axle whenever said anti-rotation force exceeds a predetermined threshold wherein said disk body continues to rotate freely and said axle rod rotates slower than said disk body while said anti-rotation force is applied.

2. The gyroscopic toy of claim 1 wherein said safety includes both a ratchet assembly and a pawl assembly.

3. The gyroscopic toy of claim 1 wherein said axle rod is repeatedly attachable to said disk body and repeatedly detachable from said disk body.

4. A method of operating a toy gyroscope, the method including the steps of:

(a) rotating gyroscopically a disk body;

(b) inducing a rotating of an elongated central axle rod extending from both sides of said disk body in response to said rotating of said disk body;

(c) reducing said inducing of said rotating of said elongated central axle rod upon application of an anti-rotation force to said axle rod that exceeds a pre-determined threshold wherein said disk body continues to rotate freely and said axle rod rotates slower than said disk body while said anti-rotation force is applied.

* * * * *